US006065408A

United States Patent [19]

Tillim et al.

[11] Patent Number: 6,065,408

[45] Date of Patent: May 23, 2000

[54] SECURITY CASE

[75] Inventors: Anthony Frank Tillim; Kevin Edward Moulder, both of Durban, South Africa

[73] Assignee: SafeCash Technologies Limited, South Africa

[21] Appl. No.: 09/149,584

[22] Filed: Sep. 8, 1998

[30] Foreign Application Priority Data

Sep. 8, 1997 [ZA] South Africa ..... 97/8043

[51] Int. Cl.[7] ..... E05G 1/00

[52] U.S. Cl. ..... 109/25; 109/29; 109/38; 109/45; 109/50; 70/63

[58] Field of Search ..... 109/25, 29, 20, 109/21, 31, 32, 38, 39, 43–45, 49, 50, 52; 70/63

[56] References Cited

U.S. PATENT DOCUMENTS

| | | | |
|---|---|---|---|
| 1,606,258 | 11/1926 | Morssen | 109/25 |
| 3,797,006 | 3/1974 | Reininger | 340/274 |
| 4,649,833 | 3/1987 | Cummins | 109/25 |
| 4,651,544 | 3/1987 | Hungerford | 70/63 |
| 4,688,023 | 8/1987 | McGill et al. | 340/545 |
| 4,722,435 | 2/1988 | Mareels et al. | 109/40 X |
| 4,768,021 | 8/1988 | Ferraro | 109/38 X |
| 4,838,052 | 6/1989 | Williams et al. | 70/63 |
| 4,942,831 | 7/1990 | Tel | 109/25 X |
| 5,111,755 | 5/1992 | Rouse | 70/63 X |
| 5,410,896 | 5/1995 | Gleason | 109/29 X |
| 5,460,020 | 10/1995 | Hungerford | 70/63 |
| 5,615,625 | 4/1997 | Cassidy et al. | 109/45 |
| 5,826,715 | 10/1998 | Thompson | 70/63 X |

FOREIGN PATENT DOCUMENTS 9418651 8/1994 WIPO .

*Primary Examiner*—Suzanne Barrett

*Attorney, Agent, or Firm*—Ostrolenk, Faber, Gerb & Soffen, LLP

[57] ABSTRACT

A security case includes a body and a lid. The lid is manipulatable between a closed and an open configuration. The case further includes a controller and a configuration sensitive switch connected thereto. An electro-mechanical locking arrangement and an audible indicator are connected to the controller to be controlled thereby. The controller is responsive to the configuration sensitive switch to cause the indicator to provide a first indication while the case is open, and to cause the locking arrangement automatically to lock the case when the case enters the closed configuration.

24 Claims, 6 Drawing Sheets

SECURITY CASE

INTRODUCTION AND BACKGROUND

The invention relates to a portable security case and more particularly to such a case for transporting valuables.

The applicant has identified a need for a security case for transporting valuables, such as cash and other valuables over relatively short distances. These short distances are typically "across the pavement" between a security vehicle (for transporting the valuables between a sender thereof and a receiver thereof) and the premises of the sender or the receiver. Although security cases suitable for the aforementioned use are known and available, they all suffer from one or another disadvantage. For example, an underhand bearer of the known cases may upon receipt of the goods in the case deliberately not close the case completely, thereby preventing the built-in protection and tamper sensitive mechanisms of the known cases to be activated or armed. The goods may thus subsequently and before the case reaches the vehicle, be pilfered from the case, without detection thereof by the aforementioned mechanisms.

OBJECT OF THE INVENTION

Accordingly it is an object of the present invention to provide an alternative case with which the applicant believes the aforementioned disadvantages may at feast be alleviated.

SUMMARY OF THE INVENTION

According to the invention there is provided a security case, the case including:

a body;

a lid mounted on the body and which lid is manipulatable between a first position wherein the case is in an open configuration and a second position wherein the case is in a closed configuration;

an electronic controller located in the case;

configuration sensitive means connected to the controller and which means is sensitive to whether the case is in the open or in the closed configuration;

locking means for locking the lid on the body in the closed configuration and which locking means is connected to the controller to be controlled thereby; and indicator means also connected to the controller to be controlled thereby;

the controller being responsive to one configuration sensitive means to cause the indicator means to provide a first indication while the case is in the open configuration.

The indicator means may include an audible alarm and/or a visible indicator.

The body and lid may be made of a suitable resinous material such as PVC and the lid may be hinged to the body, preferably at one end thereof.

The locking means may include a locking member, preferably a locking plate including a locking formation; and electronic drive means, preferably an electric motor for driving the plate, to cause the locking formation to engage and disengage a cooperating formation on the case, thereby to lock, or unlock the lid from the body.

The case may further include code receiving means connected to the controller for receiving an authorized code and to forward data relating to the code to the controller to cause the locking means to unlock the case and/or to control the indicating means. The code receiving means may for example include any one or more of a keypad; a radio frequency signal receiver; and a reader for a preprogrammed code carrying device or key.

The case may further include tamper sensitive means, preferably in the form of a tamper sensitive lining associated with at least one wall of the body and the lid and connected to the controller, the tamper sensitive means being operative in the event of tampering with the wall, to transmit a signal indicative thereof to the controller.

The case may further comprise a canister arrangement holding an incineration agent and/or a dying agent, the canister arrangement including an electronically operable release mechanism which is connected to be controlled by the controller, to release said agents. The incineration agent, in use, serves to incinerate plastic bags or the like in which banknotes may be stored in the case. The dying agent serves to colour exposed goods.

The case may further include a moisture sensitive dying agent for dying the contents of the case, should the case be submerged in a liquid, such as water.

The case may be associated with a host receptacle or sleeve for removably receiving the case, to reset the controller to a reset mode and to charge a rechargeable battery carried in the case for providing the controller and associated electronic components with electrical power.

The case may also include a handle; and handle engagement sensitive means which is activated when the handle is engaged and which means is connected to the controller to transmit to the controller a first signal when the handle is engaged.

The controller may further include timer means for arming the engagement sensitive means a predetermined time period after the handle has been engaged for the first time to transmit to the controller a second signal, should the handle be released.

The controller is sensitive to said second signal and upon reception thereof is responsive to activate the indicator means to provide a second indication, indicating that the handle has been released. The controller is preferably responsive further to activate said release mechanism of the canister arrangement, if the controller is not reset within a further time period after release of the handle.

The controller may further be responsive to the configuration sensitive means to cause the locking means automatically to lock the case when the case enters the closed configuration.

The controller may yet further be responsive upon reception of said authorized code to cause the locking means to release the lid from the body, so that the case may be opened and to cause the indicator means to provide said first indication as hereinbefore described. The case may now be cleared or loaded while the indicator means indicates, preferably audibly, that the case is still in the open configuration.

The controller may still further be responsive to said configuration sensitive means to cause the indicator means to provide a third indication when the case enters the closed configuration, the third indication serving to indicate that the case has been closed, but that the handle has not yet been engaged. The third indication thus urges a bearer to engage the handle, so that the handle engagement sensitive means may be armed as hereinbefore described. The controller causes said third indication to be terminated upon reception of the first signal from the handle engagement sensitive means.

The case may also include a gauntlet for protecting a handle region of the case.

The invention also extends to a security case system including a case as hereinbefore defined and a host receptacle for removably receiving the case.

BRIEF DESCRIPTION OF THE ACCOMPANYING DIAGRAMS

The invention will now further be described, by way of example only, with reference to the accompanying diagrams wherein.

DESCRIPTION OF A PREFERRED EMBODIMENT OF THE INVENTION

Figure 1:
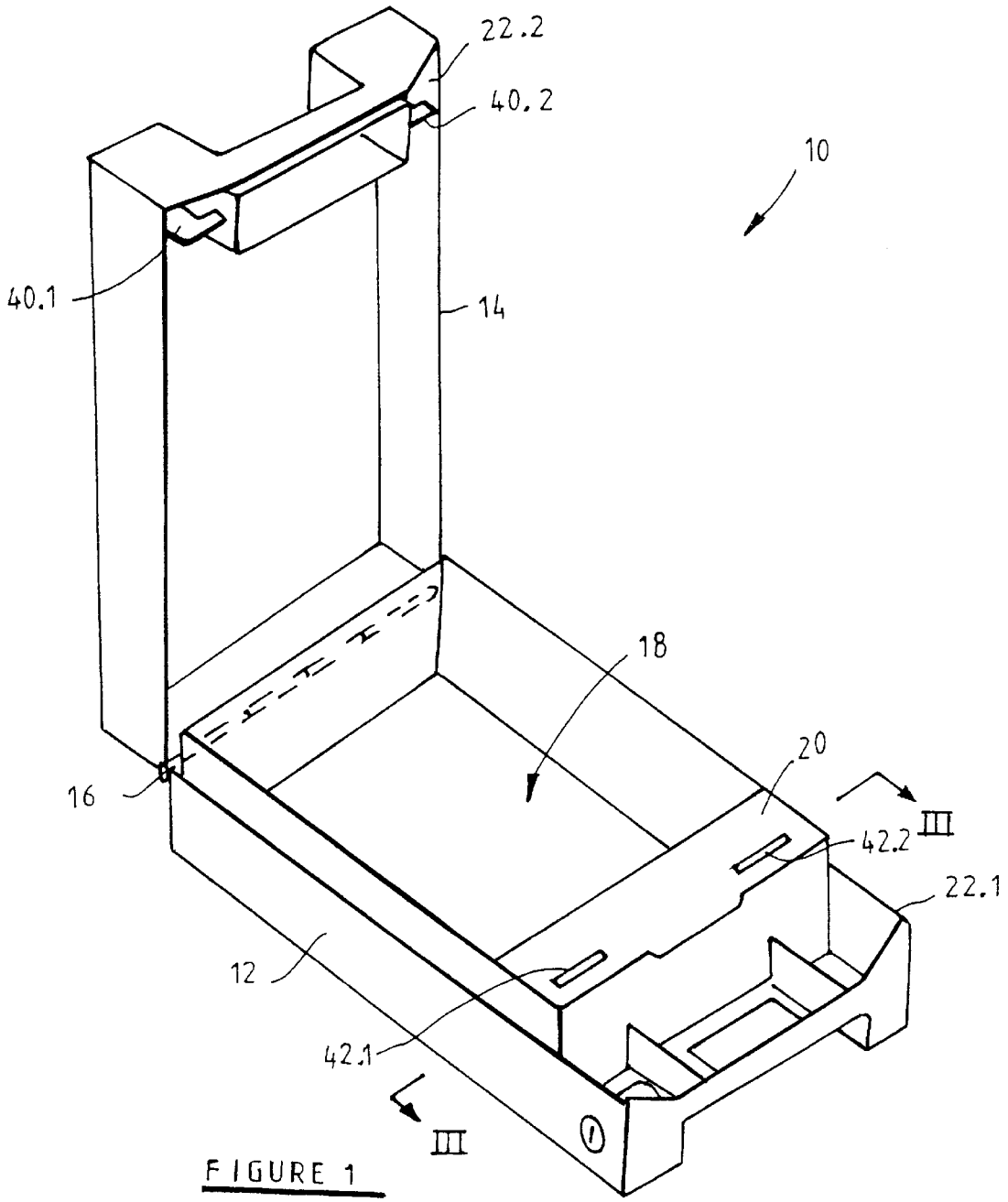
FIG. 1 is a diagrammatic perspective view of the case according to the invention in an open configuration.

A security case according to the invention is generally designated by the reference numeral 10 in the diagrams.

The generally rectangular case 10 is made of PVC and comprises a body 12 and a lid 14 hinged to the body at 16 at one end thereof. The lid is manipulable between a first position (shown in FIG. 1) wherein the case is in an open configuration and a second position (shown in FIG. 2) wherein the case is in a closed configuration. The body 12 defines a region 18 for removably receiving valuables. In the case 10 and towards the other end of body 12 there is provided a closed metal housing 20 defining a chamber 30 housing part of a locking arrangement 32 (shown in FIGS. 3 and 4). A rechargeable battery designated 52 in FIG. 5, a controller 54 and other electric components, which will be described in more detail hereafter.

Figure 2:
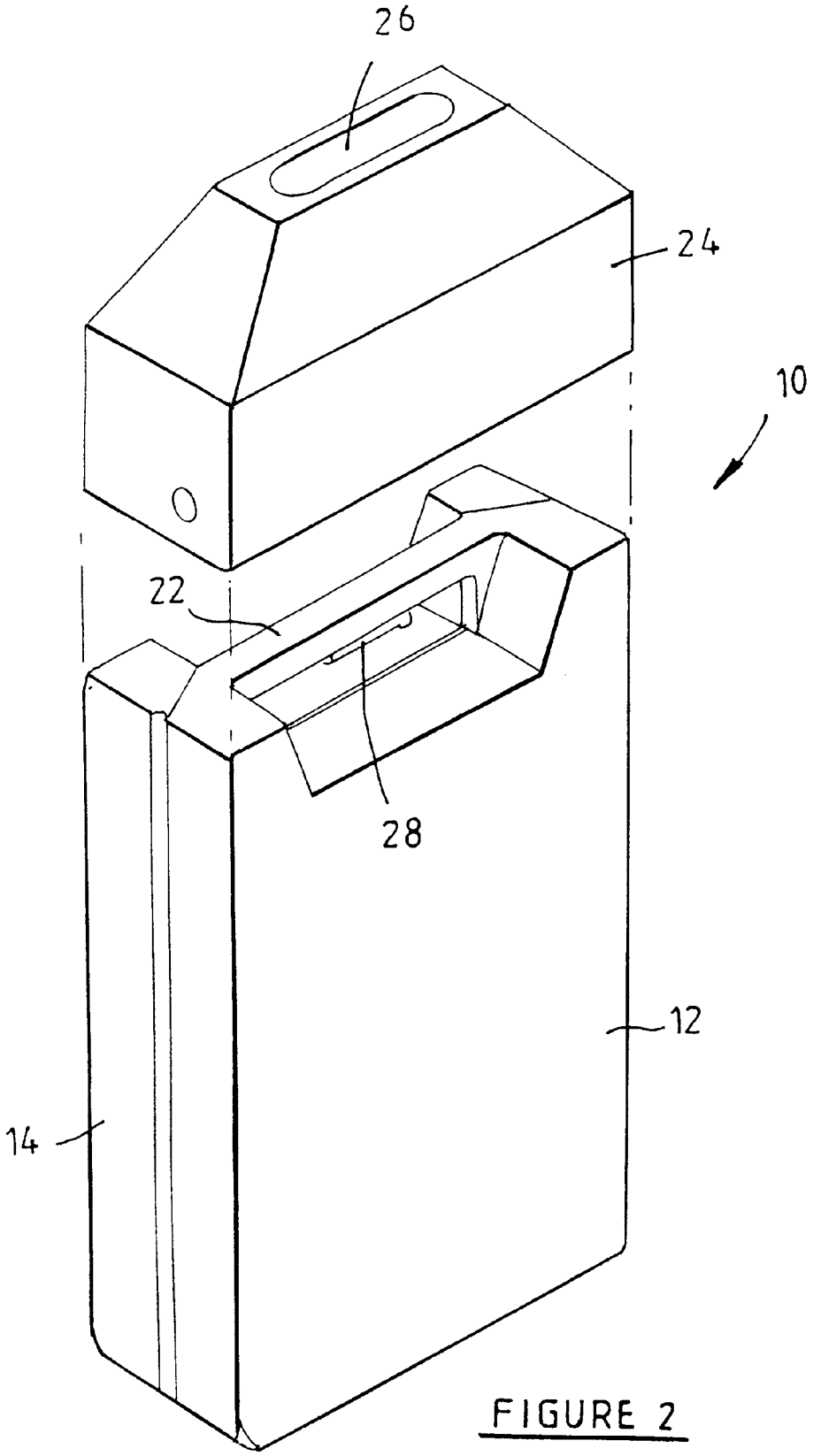
FIG. 2 is a diagrammatic perspective view of the case in a closed configuration also showing a handle engagement sensitive switch mounted on the handle of the case; and a gauntlet for protecting the handle region of the case.

Towards corresponding other ends thereof, each of the body 12 and the lid 14 comprises an integral handle half designated 22.1 and 22.2 respectively and which collectively constitute a handle 22 (shown in FIG. 2) for the case, when the case is closed. As shown in FIG. 2, the case further includes a gauntlet 24 defining an opening 26 for receiving a hand and lower arm region (both not shown) of a bearer of the case. In use, gauntlet 24 serves to protect the handle region 22 of the case. In 29 (shown in FIG. 5), which is connected to the controller 54 to provide to the controller a first signal when the switch button 28 (shown in FIG. 2) is depressed as a result of the handle being engaged, and a second signal when the handle and button 28 are released.

Figure 3:
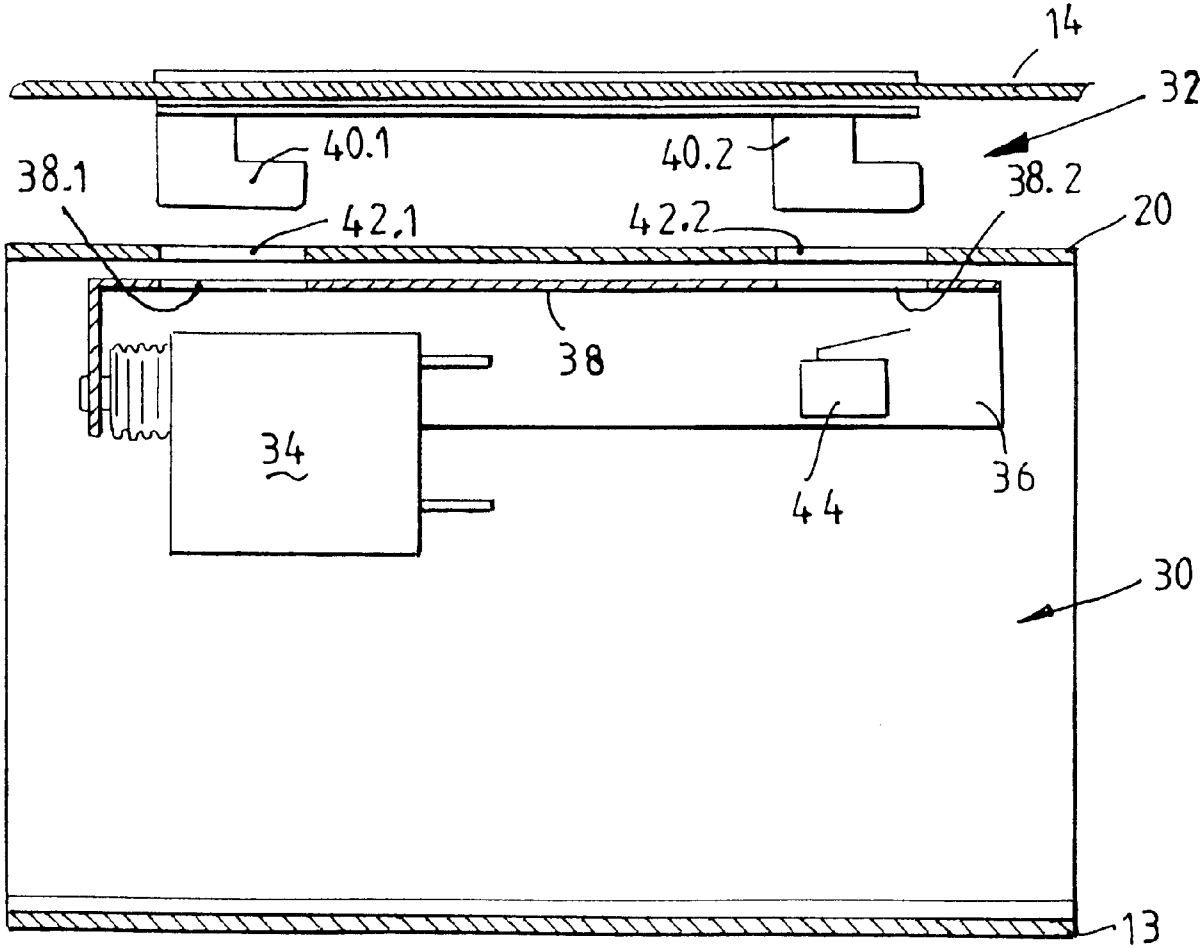
FIG. 3 is a section on line III in FIG. 1, illustrating an electro-mechanical locking arrangement for locking the lid to the body of the case.
Figure 4:
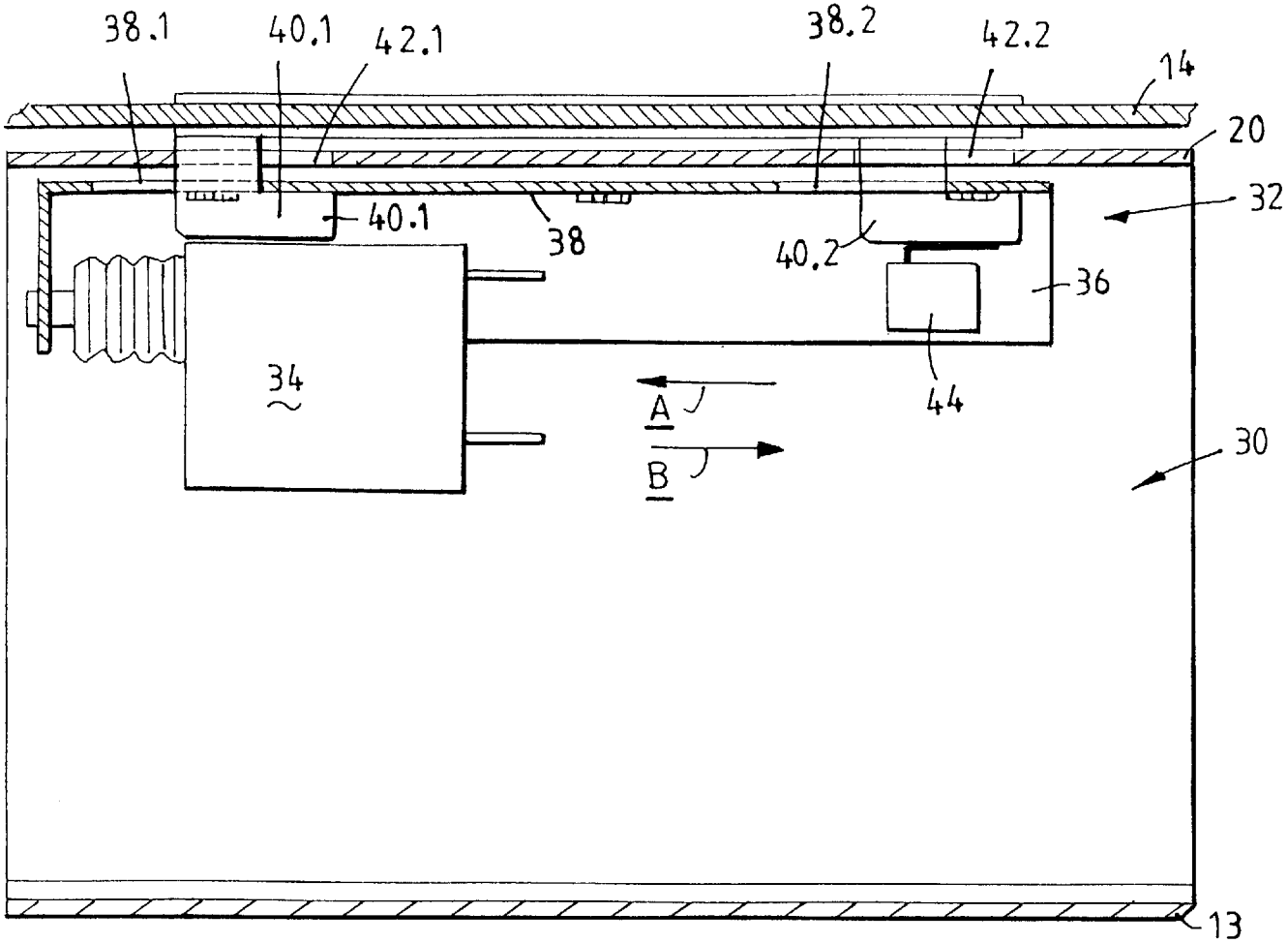
FIG. 4 is a similar section, but with the case in a closed and locked configuration.

In FIGS. 3 and 4 there is shown an electro-mechanical locking arrangement 32 for automatically locking the lid 14 to the body 12 when the case enters the closed configuration. Part of the locking arrangement 32 is located in chamber 30 and the other part is mounted on lid 14. The locking arrangement comprises an electric motor 34 which is connected to the controller 54, to be controlled thereby. The motor 34 serves selectively to drive an elongate locking plate 36 in reciprocating manner as will herein be described. Plate 36 comprises a perpendicular flange 38 extending parallel to a base 13 of body 12 and defining upwardly facing slots 38.1 and 38.2. The locking arrangement 32 further includes two foot shaped depending lugs 40.1 and 4.2 mounted on lid 14 and which are also shown in FIG. 1 Slots 42.1 and 42.2 are defined in metal housing 20 for removably receiving the lugs 40.1 an 40.2 respectively. In chamber 30 there is also located configuration sensitive means in the form of a micro-switch 44. Micro-switch 44 is also connected to controller 54.

When the lid is in the open position (as shown in FIGS. 1 and 3) plate 36 is located relative to housing 20 such that slot 38.1 is in register with slot 42.1 in housing 20; and slot 38.2 is in register with slot 42.2 in housing 20. With the plate 36 in this position, the lugs 40.1 and 40.2 are receivable in the aforementioned registering slots. When the lid 14 is moved into the closed position and the case thus enters the closed configuration, lug 40.2 extends through registering slots 42.2 and 38.2 and engages micro-switch 44, as shown in FIG. 4. A signal is transmitted to controller 54 and the controller causes motor 34 to displace the plate 36 in the direction A (as shown in FIG. 4) thereby to move slots 38.1 and 38.2 out of register with slots 42.1 and 42.2 respectively, thereby to engage foot formations 40.1 and 40.2, as shown in FIG. 4 and to lock the lid 14 onto the body 12.

Figure 5:
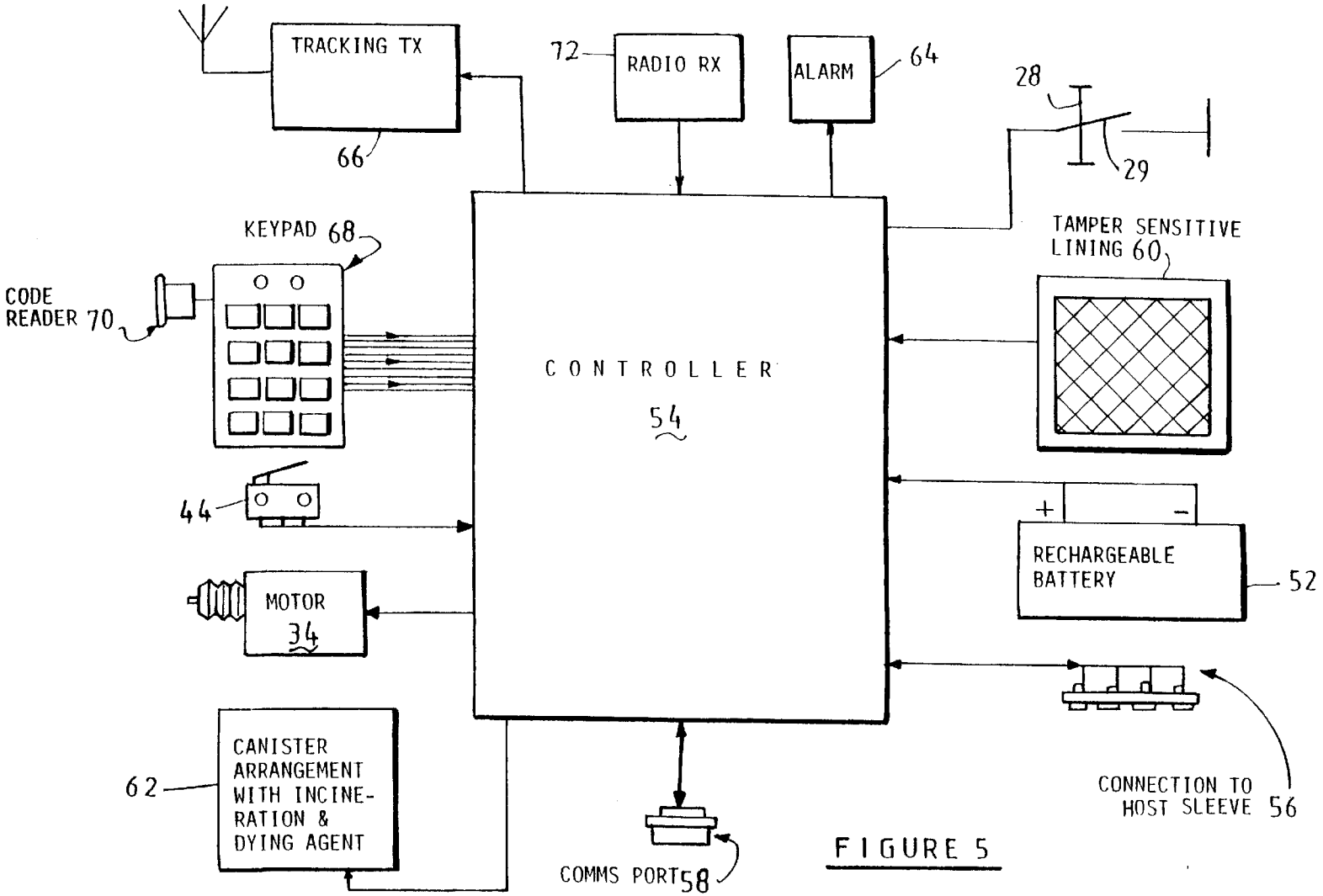
FIG. 5 is a block diagram of an electronic controller forming part of the case and various other components connected thereto.

A functional block diagram of the controller 54 associated with various input devices and devices controlled thereby is shown in FIG. 5. Controller 54 including a timer (not shown) is connected to the aforementioned electric motor 34, micro-switch 44 and rechargeable battery 52. Also connected to the controller 54 are a connector 56 for connecting the controller to an electric circuit, including a battery recharge circuit, of a host sleeve (not shown), a communications port 58 and a tamper sensitive lining 60 for the case. Should the case be broken into by breaking any of the walls of the body or the lid, the lining will be ruptured. The lining is arranged and connected to transmit an appropriate signal to the controller 54. Further connected to be controlled by the controller is an electronic release valve (not shown) of a canister 62 located in the case and which canister holds an incineration agent and/or a dying agent. The incineration agent when released, serves to incinerate plastic bags or the like wherein banknotes may be stored in the case, and the dying agent serves to dye the resulting exposed contents of the case. Indicator means in the form of an audible alarm 64 mounted on the case 10 is also connected to be controlled by the controller 54—as is an optional case tracking transmitter 66. Code receiver means in the form of a keypad 68, a reader 70 for a preprogrammed code carry key (not shown) and a radio signal receiver 72 are also connected to the controller, to transmit a code received, to the controller.

Figure 6:
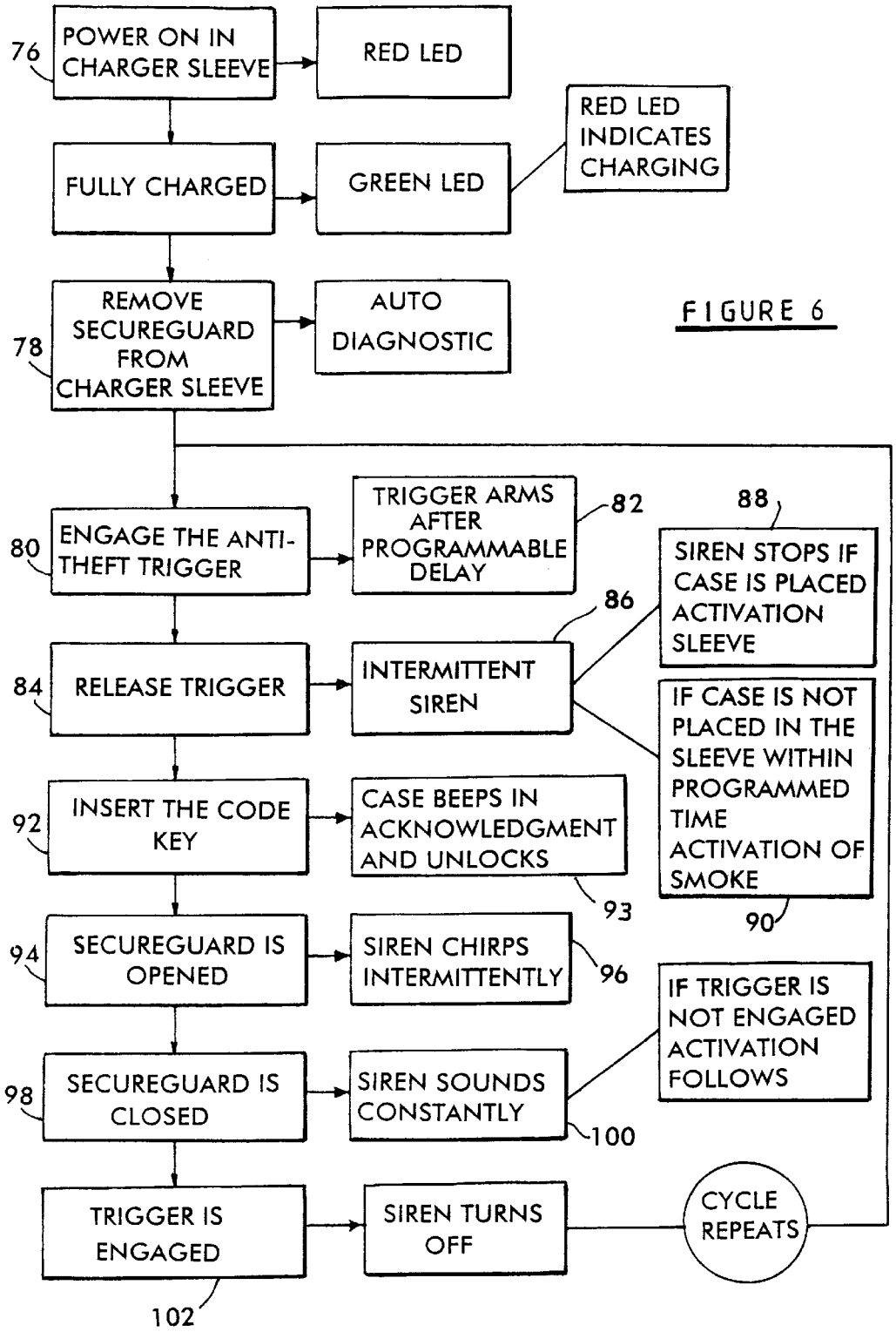
FIG. 6 is a flow diagram illustrating operation of the controller and the case in use.

In FIG. 6, there is shown a flow diagram illustrating operation of the case, in use.

At 76, the case 10 is shown) located in a host sleeve (not shown and which typically is located in a vehicle (also not shown) for transporting valuables from a sender to a receiver thereof), so that the battery 52 in the case may be recharged and the controller 54 be reset. When the case is removed from the sleeve at 78, a self-diagnostic test is performed by the controller 54 on the mechanisms of the care.

To remove the case as aforesaid, the bearer inserts his hand through opening 26 in the gauntlet 24 and grips the handle 22 as indicated at 80. At the same time switch button 28 is depressed, causing the aforementioned first signal to be transmitted to the controller 54. A first time period after first engagement of the button 28 as determined by the aforementioned timer, an anti-theft mechanism of the case is armed, as illustrated in 82. Should the button 28 be released after this first time period, for example at 84, alarm 64 is caused at 86 to provide a third of a plurality of audible indications. The indication may be stopped by immediately relocating the case in the host sleeve as shown at 88. However, if the case is not so reinserted within a predetermined time period after the button has been released, it may be a theft situation and the controller 54 accordingly causes the valve of canister 62 to release the incineration and dying agents, as illustrated at 90.

To unlock the case 10, an authorised code needs to be entered into controller 54 via any one of keypad 68, code reader 70 and radio signal receiver 72. This is illustrated at 92 in FIG. 6. The unlocking operation shown at 93 includes causing the motor 34 to move plate 36 in direction B shown in FIG 4, until it is in the position shown in FIG. 33. The lugs 40.1 and 40.2 are hence released, so that the lid may be lifted. As the case is opened at 94, the controller causes the alarm 64 to provide a first of the plurality of audible indications as shown at 96, to indicate that the case is open and not yet closed. This will enable a sender of valuables to verify that the bearer closes the case properly, after it has been loaded with valuables, so that the security and anti-theft mechanisms of the case are property armed and initiated as herein described.

When the case is closed us indicated at 98, the controller 54 causes the alarm 64 to provide a second of the plurality of indications, as indicated at 100. This indication urges the bearer to engage the handle and button 28 as shown at 102, which in turn causes the controller 54 to turn the alarm 64 off. The operation now loops back to block 80 and the procedure is repeated, as will be clear from FIG. 6.

It will be appreciated that there are many variations in detail on the security case according to the invention, without departing from the scope and spirit of the appended claims.

What is claimed is:

1. A security case comprising:

a body;

a lid mounted on the body and the lid is manipulatable between a first position wherein the case is in an open configuration and a second position wherein the case is in a closed configuration;

an electronic controller located in the case;

configuration sensitive means connected to the controller and the configuration sensitive means is sensitive to whether the case is in the open or in the closed configuration;

locking means for locking the lid on the body in the closed configuration and the locking means is connected to the controller to be controlled thereby; and indicator means also connected to the controller to be controlled thereby;

the controller being responsive to the configuration sensitive means to cause the indicator means to provide a first indication while the case is in the open configuration;

a handle; and handle engagement sensitive means connected to the controller, the handle engagement sensitive means being arranged on the case to be actuated when the handle of the case is engaged to transmit a first signal to the controller.

2. A security case as claimed in claim 1 wherein the indicator means includes at least one of an audible alarm and a visible indicator.

3. A security case as claimed in claim 1 wherein the body and lid are made of a resinous material and wherein the lid is hinged at one end thereof to the body.

4. A case as claimed in claim 1 wherein the locking means is located in the body and includes a locking member including a locking formation;

case further including electric drive means for driving the member to cause the locking formation to engage and disengage a cooperating formation on the lid, to thereby lock and unlock the lid from the body.

5. A case as claimed in claim 1 further comprising code receiving means connected to the controller, the code receiving means being operative to receive an authorized code and to forward data relating to the code to the controller to cause the locking means to unlock the lid from the body.

6. A case as claimed in claim 1 wherein at least one wall of the body and lid is associated with tamper sensitive means connected to the controller, the tamper sensitive means being operative in the event of tampering with the wall, to transmit a signal indicative thereof to the controller.

7. A case as claimed in claim 1 further comprising a canister arrangement holding at least one of an incineration agent and a dying agent, the canister arrangement including an electronically operable release mechanism which is connected to be operated by the controller, to release at least one of said agents.

8. A case as claimed in claim 1 wherein the controller includes a timer to cause the engagement sensitive means to be armed a predetermined time period after the handle has been engaged for a first time, and to transmit a second signal to the controller, when the handle is released.

9. A case as claimed in claim 8 wherein the controller is sensitive to the second signal and upon reception thereof is responsive to activate the indicator means to provide a second indication, indicating that the handle has been released.

10. A case as claimed in claim 9 wherein the controller is responsive to activate a release mechanism of a canister arrangement including at least one of an incineration agent and a dying agent, if the controller has not been reset within a further predetermined time period after the handle has been released.

11. A case as claimed in claim 1 wherein the controller is responsive to the configuration sensitive means to cause the locking means to automatically lock the case when the case enters the closed configuration.

12. A case as claimed in claim 11 wherein the controller is further responsive to the configuration sensitive means to cause the indicator means to provide a third indication wherein the case enters the closed configuration, the controller causes the indicator to provide the third indication until the handle engagement sensitive means has been actuated.

13. A case as claimed in claim 1 further comprising a gauntlet defining an opening for protecting the handle of the case.

14. A security case system comprising:

a case as claimed in claim 1;

a host receptacle for removably receiving the case, the receptacle including a controller for resetting the controller of the case; and battery charging circuitry to recharge a rechargeable battery onboard the case.

15. A case as claimed in claim 1 wherein:

the controller includes a timer which is operative to cause the handle engagement sensitive means to be armed a predetermined period of time after the handle has been engaged for a first time; and the handle engagement sensitive means is operative to transmit a second signal to the controller when the handle is released.

16. A case as claimed in claim 8 wherein the controller is sensitive to the second signal and upon reception thereof is responsive to activate the indicator means to provide a second indication indicating that the handle has been released.

17. A case as claimed in claim 8 wherein the controller is further responsive to activate a release mechanism of a canister arrangement including at least one of an incineration agent and a dying agent, when the controller has not been reset within a further predetermined time period after the handle has been released.

18. A case as claimed in claim 1 wherein the controller is responsive to the configuration sensitive means to cause the locking means to automatically lock the case when the case enters the closed configuration.

19. A case as claimed in claim 18 wherein the controller is responsive to the configuration sensitive means to cause the indicator means to provide a third indication when the case enters the closed configuration until the handle engagement sensitive means has been actuated.

20. A security case comprising:

a body;

a lid mounted on the body and the lid is manipulatable between a first position wherein the case is in an open configuration and a second position wherein the case is in a closed configuration;

an electronic controller located in the case;

a configuration sensitive switch, connected to the controller, the switch is sensitive to whether the case is in the open or in the closed configuration;

a lock for locking the lid on the body in the closed configuration, the lock is connected to the controller to be controlled thereby;

an indicator also connected to the controller to be controlled thereby;

the controller being responsive to the configuration sensitive switch to cause the indicator to provide a first indication while the case is in the open configuration;

a handle on the case; and a handle engagement sensitive switch connected to the controller, the handle engagement sensitive switch being arranged on the case to be actuated when the handle of the case is engaged to transmit a first signal to the controller.

21. A case as claimed in claim 20 wherein the controller includes a timer to cause the engagement sensitive means to be armed a predetermined time period after the handle has been engaged for a first time, and to transmit a second signal to the controller, should the handle be released.

22. A case as claimed in claim 21 wherein the controller is sensitive to the second signal and upon reception thereof is responsive to activate the indicator means to provide a second indication, indicating that the handle has been released.

23. A case as claimed in claim 22 wherein the controller is responsive to activate a release mechanism of a canister arrangement including at least one of an incineration agent and a dying agent, if the controller has not been reset within a further predetermined time period after the handle has been released.

24. A case as claimed in claim 20 further comprising a gauntlet defining an opening for protecting the handle of the case.

* * * * *

UNITED STATES PATENT AND TRADEMARK OFFICE

CERTIFICATE OF CORRECTION

PATENT NO : 6,065,408

DATED : May 23, 2000

INVENTOR(S) : Anthony Frank Tillim and Kevin Edward Moulder

It is certified that error appears in the above identified patent and that said Letters Patent are hereby corrected as shown below.

Please correct the name of the Assignee as follows:

On the cover sheet of the patent, [73] Assignee, should read:

--SafeCash Technologies (Proprietary) Limited--

Signed and Sealed this

Third Day of April, 2001

*Attest:*

Nicholas P. Godici

NICHOLAS P. GODICI

*Attesting Officer*

*Acting Director of the United States Patent and Trademark Office*